United States Patent [19]

Finger

[11] 4,006,415

[45] Feb. 1, 1977

[54] FAST RESET INTEGRATOR

[75] Inventor: Eugene P. Finger, Brewster, N.Y.

[73] Assignee: Curtis Instruments, Inc., Mount Kisco, N.Y.

[22] Filed: May 12, 1975

[21] Appl. No.: 576,390

[52] U.S. Cl. ..... 324/182; 324/29.5

[51] Int. Cl.[2] ..... G04F 8/00

[58] Field of Search ..... 324/94, 29.5, 181, 182

[56] References Cited

UNITED STATES PATENTS

| | | | |
|---|---|---|---|
| 3,422,337 | 1/1969 | Carson | 324/29.5 |
| 3,484,681 | 12/1969 | Grady, Jr. | 324/29.5 |
| 3,778,702 | 12/1973 | Finger | 324/29.5 |
| 3,886,442 | 5/1975 | Chiku | 324/29.5 |

*Primary Examiner*—Palmer C. Demeo
*Assistant Examiner*—Michael J. Tokar
*Attorney, Agent, or Firm*—Pennie & Edmonds

[57] ABSTRACT

An integration system is disclosed including a reversible integrating device having an integrating capacity between its upper and lower limits of integration which is at least twice that which is required for a desired application. Circuitry is provided for reading the integral stored in the integrating device and producing a voltage proportional to that integral. Circuitry is also provided for sensing which of the limits of integration is closer to said integral and a switch is provided for selecting the direction which integration will proceed so that the period of integration can always be at least half that of the integrating capacity of the device. To determine the integral during the period of integration, a variable resistor is first adjusted to store a reference voltage corresponding to the integral stored in the integration device at the start of the period of integration. Thereafter this reference voltage is compared with the voltage produced by the circuit that reads the integrating device to indicate the value of the integral accumulated in the integrating device from the start of the period of integration.

17 Claims, 3 Drawing Figures

FAST RESET INTEGRATOR

BACKGROUND OF THE INVENTION

The present invention relates to integrating devices and more specifically to an integrating instrument that is quickly resettable and is capable of measuring and indicating periods of use of a machine by integrating the total electrical current from a source that is on whenever the machine is in use. The system of the present invention is particularly useful in conjunction with an electrical integrating device known as a coulometer.

Coulometers are described in detail in Lester Corrsin's U.S. Reissue Pat. No. 27,556 entitled "Operating Time Indicator" and Curtis Beusman's U.S. Pat. No. 3,193,763 entitled "Electrolytic Coulometric Current Integrating Device", both of which are incorporated herein by reference.

The device described in these patents includes a tubular body of nonconductive material having a bore therethrough that supports two columns of a liquid metal such as mercury. The adjacent innermost ends of these columns are separated by a small volume of electrolyte with which they make conductive contact. The outermost ends of the liquid metal columns contact conductive leads that connect the instrument to the source of electric current that is to be measured. In accordance with Faraday's Law, when current flows through the instrument, liquid metal is electroplated from the anode column to the cathode column causing the anode to decrease in length and the cathode to increase an equal amount, the change in column length being directly proportional to the total electric charge passed through the instrument.

Readout of the total current through the instrument may be made by comparing the length of a column against a calibrated scale. Typical visual readout devices are described in the above-identified Corrsin patent and in Beusman's U.S. Pat. No. 3,343,083 entitled "Nonself-Destructive Reversible Electrochemical Coulometer". It has also been found that the coulometer may be read electrically by measuring changes in the capacitance between the mercury columns and an electrode surrounding the tubular body. The details of such a readout device are set forth in Edward Marwell and Curtis Beusman's U.S. Pat. No. 3,255,413 entitled "Electro-Chemical Coulometer Including Differential Capacitor Measuring Elements" and Eugene Finger's U.S. Pat. Nos. 3,704,431 and 3,704,432 entitled "Coulometer Controlled Variable Frequency Generator" and "Capacitive Coulometer Improvements", respectively, all of which are incorporated herein by reference.

SUMMARY OF THE INVENTION

The present invention is concerned with an integrating system for recording periods of use. The preferred embodiment of the invention uses a coulometer as an integrating device, although other similar electrochemical devices can be substituted. The coulometer is housed in a module and provided with special circuitry which allows the system to be conveniently and quickly reset for successive cycles of operation.

The coulometer used in the module has an integrating capacity between an upper and lower limit of integration which is set to be twice that required for a desired application. Circuitry is provided for sensing which limit of integration is closer to the electrolytic gap of the coulometer; and the module includes a switch for reversing the flow of current through the coulometer to select the limit toward which integration will proceed. This allows the user to set the integration in a direction away from the nearer limit, thereby providing a maximum time period between the previous value stored in the coulometer, which becomes a reference value, and the limits of integration.

The reference voltage value from which the coulometer starts during any given integration cycle is stored in a variable resistor. An interrogator provides a voltage at its output which is proportional to the integral stored by the coulometer. By comparing the voltage output of the interrogator with that of the variable resistor, one can obtain a measure of the integral stored since the last time the system was reset. After a reading is taken and recorded, the variable resistor in the module is zeroed to the new reference by adjusting the variable resistor until a zero indication is displayed by the meter. The direction of integration may also be reset.

Feedback control circuitry for automatically setting the direction of integration and zeroing the variable resistor may also be included in the system. Such a system may use a modular arrangement in which a module containing the switch, variable resistor, and coulometer would be transferred from the machine whose use is being monitored to a monitoring station. The system may also include circuitry for reading the coulometer and storing the reading along with indexing information that might, for example, identify the device whose use is being measured.

DETAILED DESCRIPTION OF THE PREFERRED EMBODIMENTS

Figure 1:
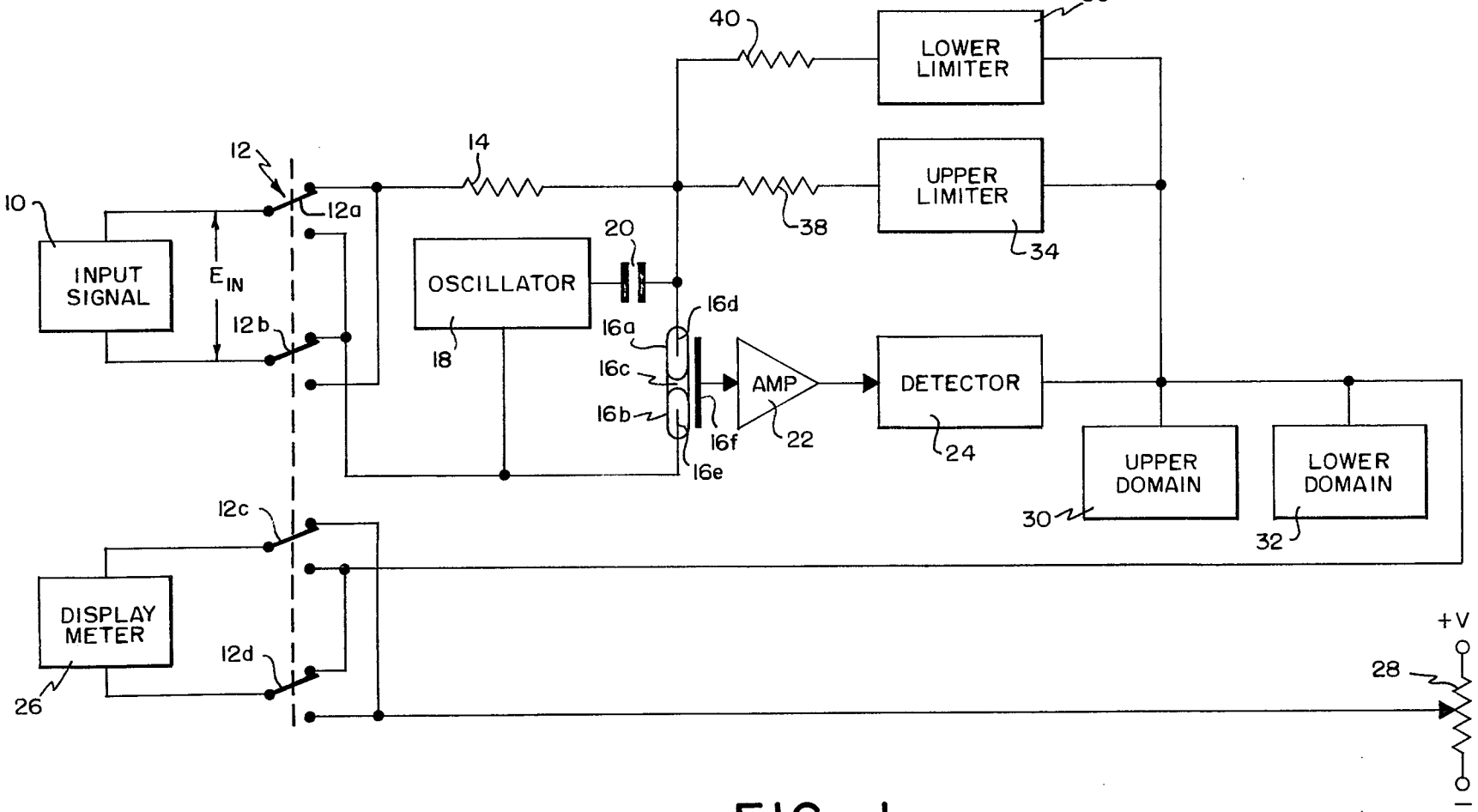
FIG. 1 is a block diagram of an illustrative coulometer system constructed in accordance with the present invention.

Referring to FIG. 1, the system includes a source of signals 10 which is coupled by switch sections 12*a* and 12*b* of four-pole two-position switch 12 and a metering resistor 14 to a coulometer 16. The length of the time period of integration can be varied by varying the value of resistor 14. Signal source 10 is any source, the magnitude of which is proportional to the parameter which one desires to measure. Thus, if one wishes to measure the time during which a machine is operating, any source of constant current that is on when the machine is operating will suffice. The direction of current through coulometer 16 can be reversed by a change in the position of switch 12. In this manner, the direction of integration in coulometer 16 is also reversed.

Coulometer 16 is a coulometer of conventional design which includes two columns of mercury 16*a*, 16*b* in a capillary tube separated by a small volume of electrolyte 16*c*. Each column 16*a*, 16*b* makes conductive contact with an electrode 16*d*, 16*e*, respectively. As current passes through the coulometer, mercury is transferred from the column at the anode of the coulometer to that at the cathode. Thus the length of the columns 16*a*, 16*b*, or the position of the electrolyte 16*c* is a measure of the current integral stored by the coulometer.

As explained in the above-referenced 3,255,413, 3,704,431 and 3,704,432 patents, the coulometer may be read out electrically by measuring changes in the capacitance between an electrode surrounding the capillary tube of the coulometer and the mercury columns as the columns change in length. The electrode is provided by a thin metal film 16*f* surrounding the coulometer tube. Read out is accomplished by an oscillator 18 which produces an AC signal which is passed through a capacitor 20 to coulometer electrode 16*d*. Since this signal has no DC component, oscillator 18 does not affect integration in the coulometer. The AC signal passing through the coulometer is coupled via plate 16*f* to an amplifier 22. The coupling to the amplifier and hence the magnitude of the signal reaching the amplifier is a function of the position of the electrolyte 16*c* in the coulometer and therefore indicates the integral stored in the coulometer. This signal is changed to a DC level by a detector 24. The output of detector 24 is coupled via switch sections 12*c* and 12*d* to a voltmeter 26. Voltmeter 26 reads the difference between the voltage output of detector 24 and the reference voltage produced by a variable resistor 28, which stores the reference value from which integration begins.

The output of detector 24 is also fed to an upper domain detector 30 and a lower domain detector 32. Detectors 30 and 32 are voltage detectors that indicate in which half or domain of the integration cycle is the electrolyte of the coulometer, and therefore tell one that integration should proceed in the opposite direction in order to maximize the period of integration. If the volume of electrolyte 16*c* is in the upper domain, detector 30 activates a visual display indicating that integration should proceed toward the lower domain. Similarly, if the electrolyte is in the lower domain, lower domain detector 32 activates a signal that indicates that integration should proceed toward the upper domain. Thus, switch 12 would be set in accordance with the information supplied by domain detectors 30 and 32. Advantageously, the visual outputs of detectors 30 and 32 may be placed beside switch 12 and the user may be instructed to turn the switch towards the indicator that is on.

The output of detector 24 is also coupled to a pair of limiters 34 and 36. Limiters 34 and 36 serve the purpose of preventing damage to coulometer 16 by preventing it from being over-driven into an irreversible region beyond the limits of integration. Thus, upon sensing that the coulometer is approaching the upper limit of integration, upper limiter 34 will pass a current via a resistor 38, which is equal in magnitude and opposite in direction to the current produced by source 10, thus stopping further integration by coulometer 16. Similarly, in the event that the coulometer is approaching the lower limit of integration, further integration will be stopped by the passage through a resistor 40 of a current equal in magnitude and opposite in direction to the current produced by source 10. This current may be set at a fixed value if the current produced by the source is fixed, or it may be made to automatically track the current from the source.

To use the coulometer, switch 12 is switched into the position which causes the integration toward the domain opposite that in which the coulometer is at the start of the cycle; and variable resistor 28 is adjusted for a zero signal indication on voltmeter 26. The input signal from source 10 is then integrated by coulometer 16. At the end of the integration cycle, the cumulative output of signal source 10 during the period of integration is read on voltmeter 26. The coulometer is then reset by properly adjusting switch 12 and resetting variable resistor 28 for a zero reading on voltmeter 26.

Figure 2A:
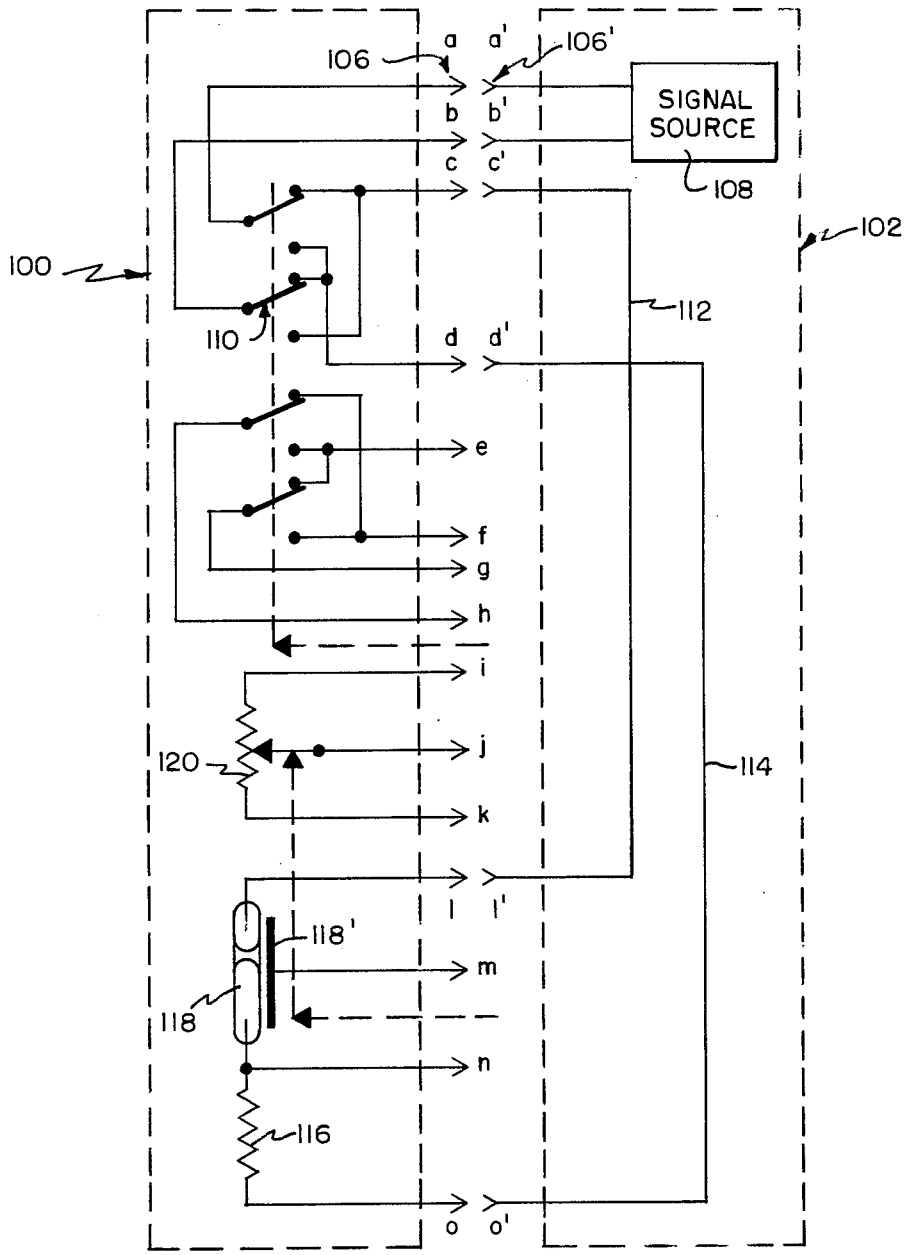
FIGS. 2A and 2B together constitute the block diagram of an alternative embodiment of the present invention.
Figure 2B:
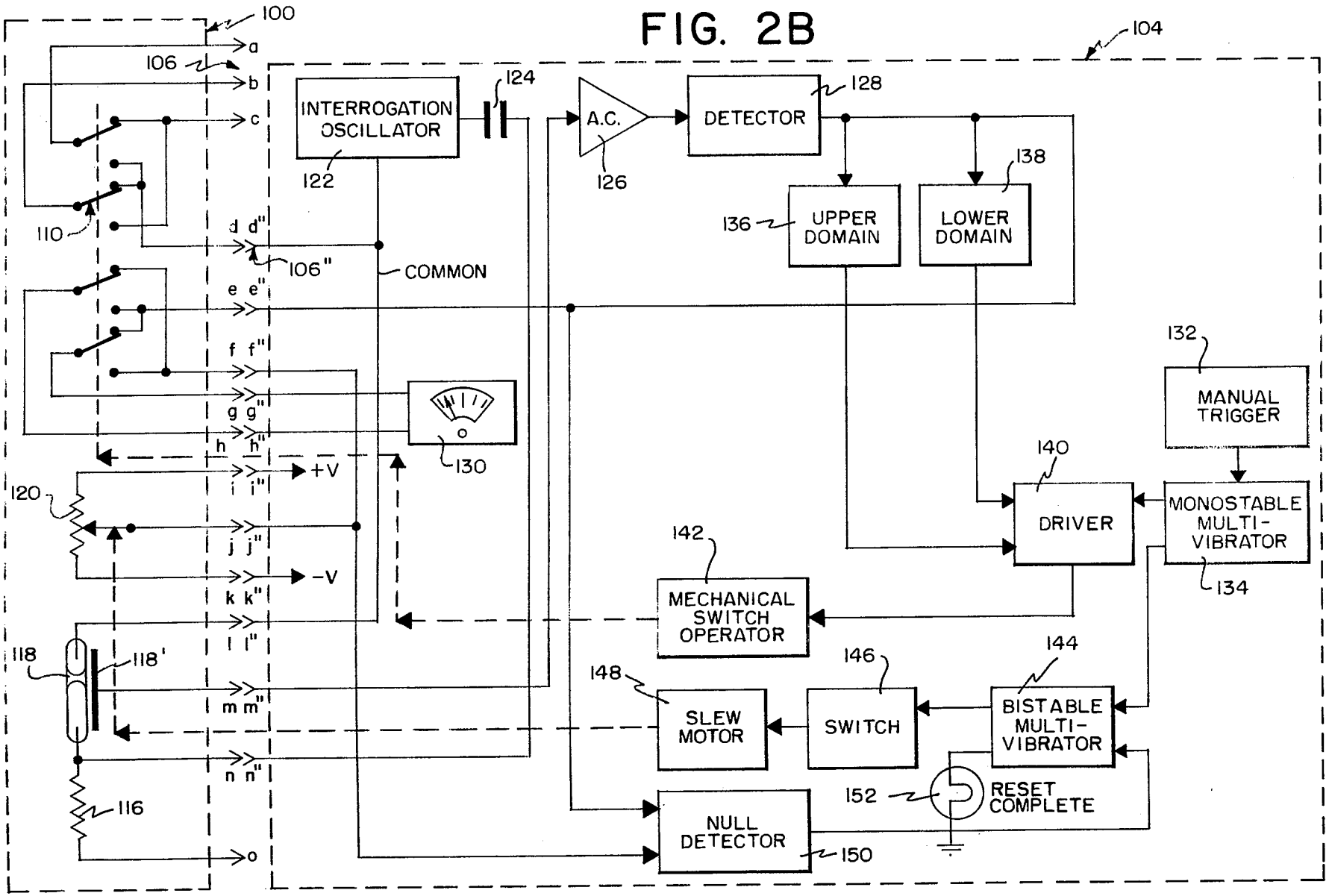

FIGS. 2A and 2B schematically illustrate a monitoring system which includes a module 100, a mating machine circuit 102, and a monitor circuit 104. This system operates in a manner similar to the device illustrated in FIG. 1. During use, module 100 is plugged into mating machine circuit 102 on a machine whose use is to be monitored. Module 100 mates with mating machine circuit 102 via mating connectors 106 in module 100 and 106' in mating machine circuit 102. Mating circuit 102 includes a signal source 108 which passes current via a switch 110 and a pair of connection loops 112 and 114 through a metering resistor 116 and a coulometer 118. The direction of current flow through the coulometer may be reversed by reversal of the position of switch 110. The reference point from which integration starts is stored by a potentiometer 120 which functions in the same manner as variable resistor 28 of FIG. 1.

When it is desired to know the integral stored since the last tine the reference point was set, module 100 is unplugged from mating connector 106' in the machine and plugged into connector 106'' which connects the module to the monitor circuit 104. The monitor circuit essentially comprises reading circuitry, which operates in the same general manner as in the device illustrated in FIG. 1, combined with circuitry for automatically resetting switch 110 and potentiometer 120 which stores the reference point from which integration is made in the same manner as variable resistor 28 in FIG. 1. Monitor circuit 104 includes an oscillator 122 which generates an AC signal which is coupled via a capacitor 124 to coulometer 118. The signal is capacitively coupled to shield 118', where its amplitude is a function of the position of the electrolyte in the coulometer and therefore indicates the integral stored in coulometer 118.

The signal on shield 118' is amplified in amplifier 126 and sent to a detector 128 which produces a DC signal proportional to the amplitude of the AC signal received by amplifier 126. The output of detector 128 is coupled via switch 110 to a meter 130. Insofar as the polarity of the voltage sensed by meter 130 will vary dependent upon whether integration has proceeded in one direction or the other, switch 110 has the effect of connecting the meter with the proper polarity.

The proper position of switch 110 is determined by an upper domain detector 136 and a lower domain detector 138 which perform essentially the same functions as domain detectors 30 and 32 in FIG. 1. Their outputs are sent to a driver 140 which in turn is coupled to a mechanical switch operator 142. Driver 140 may take any one of a number of forms, such as a pair of solenoids which operate to urge a mechanical member such as mechanical switch operator 142 in opposite directions whenever either of them is actuated. Thus, if upper domain detector 136 is activated, activation of the driver will cause mechanical switch operator 142 to put switch 110 in one state, while the lower domain indicator will put switch 110 in the opposite state. It is also possible to use a conventional stepping motor in place of operator 142, the motor being driver 140.

When it is desired to reset the coulometer module for a new cycle of integration, a trigger 132 is used to set a monostable multivibrator 134. Trigger 132 may be a simple single-pole single-throw switch in series with a capacitor connected to a voltage source. Multivibrator 134, triggered by trigger 132, has a relatively short pulse duration on the order of about 50 milliseconds. Driver 140 is actuated by the pulse output of multivibrator 134. If switch 110 is in the improper position, it will put it in the proper position. If it is in the proper position already, no change will take place.

When the pulse produced by multivibrator 134 ends, its falling edge triggers a bistable multivibrator 144 that turns on a switch 146. Switch 146 activates a slew motor 148 that starts to rotate potentiometer 120. Potentiometer 120 is of the type which can be rotated continuously through 360° of revolution. As it is rotated, the voltage which is coupled from its wiper terminal to a null detector 150 is also coupled to the output of detector 128. When the output of detector 128 equals the voltage on the wiper, null detector 150 produces a pulse which resets multivibrator 144, thereby stopping the slew motor and activating indicator 152 which indicates that reset is complete.

The module has thus been reset and the potentiometer has been adjusted to present a voltage which is equal to the voltage produced by the interrogation circuitry when the coulometer tube is connected to it. Any integration performed by the coulometer will now result in a positive or negative deviation in the output voltage of the detector. This deviation is measured by meter 130 which is connected with the proper polarity for either positive or negative deviation by switch 110.

It is understood that various modifications may be made to the described circuits by those skilled in the art. For example, although a system using an electrochemical coulometer cell has been disclosed, any other integrating device can be used. It may be desired to simplify the circuitry in the coulometer module by replacing the four-pole two-position switch with a simple spst switch or any other bistable element which may be read by appropriate circuitry to provide the same control functions as a four-pole two-position switch. It may also be desired to use data processing equipment to read the integrator and record the reading and then automatically reset the module. Similarly, it may also be desirable to utilize the modular concept as illustrated in FIGS. 2A and 2B without the automatic resetting circuitry. These modifications are considered to be within the scope of the invention as defined by the following claims.

I claim:

1. A system for monitoring the use of a plurality of machines comprising:

a. a module comprising:
  i. first switch means;
  ii. second switch means coupled to said first switch means;
  iii. integrating means having first and second limits of integration, said integrating means being capable of integration in a first direction toward said first limit and in a second direction toward said second limit;
  iv. a variable resistance;
  v. connector means connected to said first switch means, said second switch means, and said variable resistance means;
  vi. first coupling means for varying said variable resistance; and
  vii. second coupling means for changing the position of said first switch means and said second switch means;

b. machine circuitry comprising:
  i. mating connector means for mating with said connector means;
  ii. a signal source coupled to said first switch means through said connector means and said mating connector means; and
  iii. current conducting means connected to said mating connector means, said current conducting means being coupled by said mating connector means and said connector means through said switch means to said integrating means, said current conducting means coupling said signal source to said integrating means with a polarity dependent upon the position of said first switch means; and c. reading circuitry comprising:
  i. second mating connector means for mating with said connector means;
  ii. interrogator means coupled to said integrating means through said second mating connector means and said connector means for producing a DC signal proportional to said integrated value stored in said integrating means, said interrogator output being coupled to said second switch means through said connector means and said second mating connector means;
  iii. a voltage source coupled through said second mating connector means and said connector means to said variable resistance means; and
  iv. readout means coupled to said second switch means and said variable resistance means through said connector means and said second mating connector means, said readout means being connected between said variable resistance and said interrogator means with a polarity dependent upon the position of said switch means.

2. A system as in claim 1, wherein said reading circuitry further comprises:

v. domain detector means for detecting whether said integrating means is closer to the upper or the lower limit of integration;
vi. pulse producing means for producing a pulse when activated;
vii. first motor means coupled to said second coupling means responsive to said pulse producing means and said domain detector means for setting the position of said first and second switch means in such a manner that integration will occur in the direction away from the closer limit of integration when said module containing said integrating means is removed from said reading circuitry and plugged into said machine circuitry;
viii. null detector means activated by said pulse producing means and coupled to said interrogator means and said variable resistance for producing an output unless the electrical output of said variable resistance equals the electrical output of said interrogator means; and
ix. second motor means coupled to said first coupling means responsive to said null detector means to vary said variable resistance.

3. A monitoring system comprising:

an electrochemical integrating device for integrating an applied DC signal in a first direction in response to a signal applied thereto with a first polarity and in an opposite direction in response to a signal applied thereto with a second polarity;

first switch means for coupling said DC signal to said integrating device with either said first polarity or said second polarity;

means for reading the integrated value of said DC signal stored in said integrating device and producing an output DC voltage that varies in response to said integrated value;

means for storing an output DC voltage read at the beginning of an integration cycle; and a display device to which are applied a first signal corresponding to the voltage stored by said output voltage storing means and a second signal corresponding to the output DC voltage from the integrating device, said display device having an output display that is a function of the difference between said first and second signals applied thereto.

4. A monitoring system as in claim 3 further comprising second switch means for applying said first and second signals to said display device with either a first or a second polarity dependent on the polarity with which the DC signal is coupled to said integrating device.

5. A monitoring system as in Claim 4, wherein said first switch means and second switch means together comprise a four-pole two-position switch.

6. A monitoring system as in Claim 3, wherein said integrating device is a coulometer comprising:

a. a capillary tube;

b. a pair of electrodes disposed at the ends of said capillary tube;

c. two columns of mercury in said capillary tube, each of said columns in contact with one of said electrodes; and d. a quantity of electrolyte in said capillary tube between said two columns.

7. A monitoring system as in Claim 6 wherein said means for reading the integrated value and producing an output DC voltage comprises:

a. a source of AC signals;

b. means for passing said AC signals through said coulometer;

c. plate means adjacent said capillary tube capacitively coupled to said AC signals passing through said coulometer for coupling said AC signals; and d. detector means coupled to said plate means for providing to said display device a DC signal proportional to the amplitude of said AC signal.

8. A monitoring system as in claim 3 further comprising means for indicating whether the integral stored in said integrating device is closer to an upper limit of integration or to a lower limit of integration of the device.

9. A monitoring system comprising: a module comprising:

an electrochemical integrating device for integrating an applied DC signal in a first direction in response to a signal applied thereto with a first polarity and in an opposite direction in response to a signal applied thereto with a second polarity;

first switch means for coupling said DC signal to said integrating device with either said first polarity or said second polarity;

means for storing as an output DC voltage the integrated value stored in the electrochemical integrating device at the beginning of an integration cycle;

a plurality of first connector means for applying an electrical signal to said electrochemical integrating device, to said first switch means and to said storing means; and machine circuitry comprising:

a plurality of second connector means for applying an electrical signal, at least some second connector means being aligned to mate with at least some first connector means;

an electrical signal source coupled to said first switch means through at least one of said second connector means and at least one of said first connector means; and means for conducting an electrical current from said first switch means to said electrochemical integrating device, said current conducting means interconnecting a plurality of second connector means at least one of which is aligned to mate with a first connector means for applying an electrical signal to said first switch means and at least one of which is aligned to mate with a first connector means for applying an electrical signal to said electrochemical integrating device; and reading circuitry comprising:

a plurality of third connector means for applying an electrical signal, at least some third connector means being aligned to mate with at least some first connector means;

means for reading the integrated value of the DC signal stored in said electrochemical integrating device and producing an output DC voltage that varies in response to said integrated value, said means being coupled to said integrating device through at least one of said third connector means and at least one of said connector means; and a display device to which are applied a first signal corresponding to the voltage stored by said output voltage storing means and a second signal corresponding to the output DC voltage from the integrating device, said display device having an output display that is a function of the difference between said first and second signals applied thereto, said display device being coupled to said storing means through at least one of said third connector means and at least one of said first connector means.

10. A monitoring system as in claim 9 wherein:

said module further comprises a second switch means for applying said first and second signals to said display device with a first or second polarity dependent on the polarity with which the DC signal is coupled to said integrating device; and said module and said reading circuitry further comprise means for connecting said storing means and said output DC voltage to said display device via said second switch means.

11. A monitoring system as in claim 9 further comprising means for indicating whether the integral stored in said integrating device is closer to an upper limit of integration or to a lower limit of integration of the device.

12. A monitoring system as in claim 3 further comprising:

means for detecting whether the integral stored in said integrating device is closer to an upper limit of integration or a lower limit of integration of the device; and means responsive to said detecting means for setting the position of said first switch means, prior to the beginning of an integration cycle, in such a manner that integration will occur in the direction away from the closer limit of integration.

13. A monitoring system as in claim 12 further comprising second switch means for applying said first and second signals to said display device with either a first or a second polarity dependent on the polarity with which the DC signal is coupled to said integrating device, said second switch means and said first switch means being coupled together so that a change in the position of one produces a change in the position of the other.

14. A monitoring system as in claim 3 further comprising means to alter the DC output voltage of said storing means until it becomes equal to the DC output voltage of said reading means, whereby the integrated value then stored in the integrating device is stored in the storing means.

15. A monitoring system as in claim 9 further comprising:

means for detecting whether the integral stored in said integrating device is closer to an upper limit of integration or a lower limit of integration of the device; and means responsive to said detecting means for setting the position of said first switch means, prior to the beginning of an integration cycle, in such a manner that integration will occur in the direction away from the closer limit of integration.

16. A monitoring system as in claim 15 wherein:

said module further comprises a second switch means for applying said first and second signals to said display device with a first or second polarity dependent on the polarity with which the DC signal is coupled to said integrating device, said second switch means and said first switch means being coupled together so that a change in the position of one produces a change in the position of the other; and said module and said reading circuitry further comprise means for connecting said first and second signals to said display device via said second switch means.

17. A monitoring system as in claim 9 further comprising means operable at the beginning of an integration cycle to alter the DC output voltage of said storing means until it becomes equal to the DC output voltage of said reading means, whereby the integrated value then stored in the integrating means is stored in the storing means.

* * * * *